United States Patent [19]

McAteer

[11] Patent Number: 4,815,162

[45] Date of Patent: Mar. 28, 1989

[54] INDEPENDENTLY ADJUSTABLE TOP AND BOTTOM HINGE PIN ASSEMBLIES

[75] Inventor: John E. McAteer, Maple Heights, Ohio

[73] Assignee: Hauserman, Inc., Cleveland, Ohio

[21] Appl. No.: 132,180

[22] Filed: Dec. 14, 1987

[51] Int. Cl.[4] ..... E05D 7/04

[52] U.S. Cl. ..... 16/244; 16/245; 16/248; 49/388

[58] Field of Search ..... 16/238, 243, 244, 245, 16/248, 381; 49/288; 160/199

[56] References Cited

U.S. PATENT DOCUMENTS

| | | | |
|---|---|---|---|
| 487,476 | 12/1892 | Faulhaber et al. | 16/264 |
| 3,313,064 | 4/1967 | Kirby | 16/245 X |
| 3,390,486 | 7/1968 | Walters | 49/388 |

*Primary Examiner*—Fred A. Silverberg

*Attorney, Agent, or Firm*—Renner, Otto, Boisselle & Sklar

[57] ABSTRACT

A door hinge assembly includes a frame and a door with top and bottom hinge pivot assemblies. The top hinge pivot assembly includes a plate fixed to the frame and thereabove a parallel vertically movable plate. The upper plate includes a downwardly projecting hinge pin which projects through a clearance hole in the fixed plate. The fixed plate also includes an upwardly extending guide pin which extends through a clearance hole in the upper plate. A screw extends through the fixed plate and is threaded into the upper plate. When the screw is loosened the upper plate and thus the hinge pin may be pushed up, or permitted to drop into place. By tightening the screw the hinge pin is locked in its extended position and the screw head is flush with the bottom of the fixed plate. The bottom hinge pivot assembly includes an L-shape bracket with the vertical leg secured to the frame and the horizontal leg beneath the door. A threaded stud on the horizontal leg threadedly supports a nut-pin assembly with the upwardly projecting pin surrounded by a flat shoulder. A thrust washer on the shoulder supports the weight of the door and the door may be height adjusted by rotating the nut-pin assembly on the threaded stud and locking it in position.

10 Claims, 1 Drawing Sheet

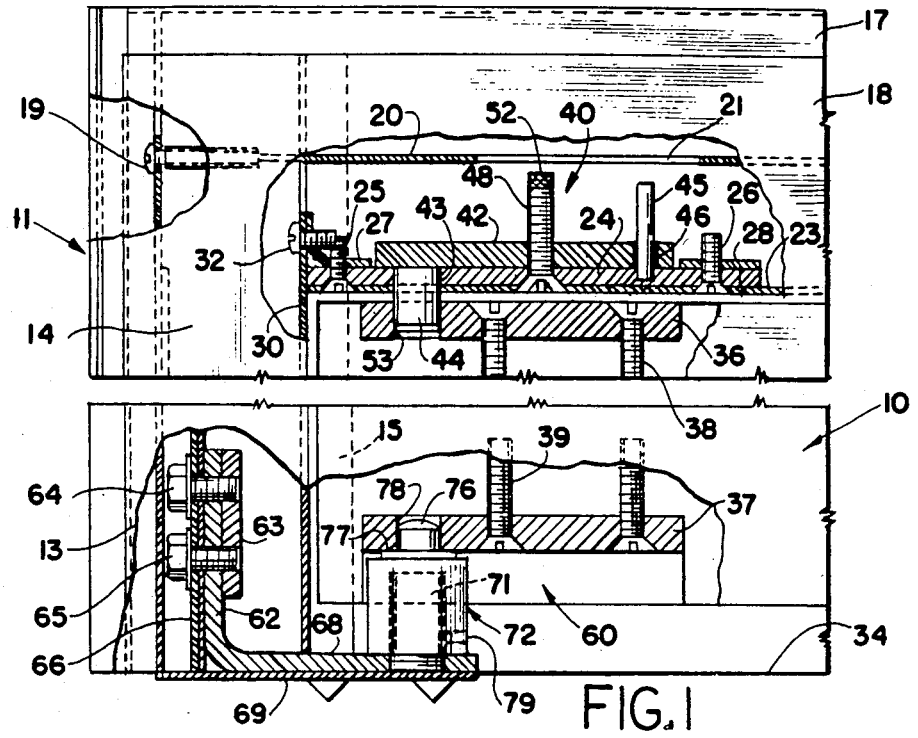
FIG. 1
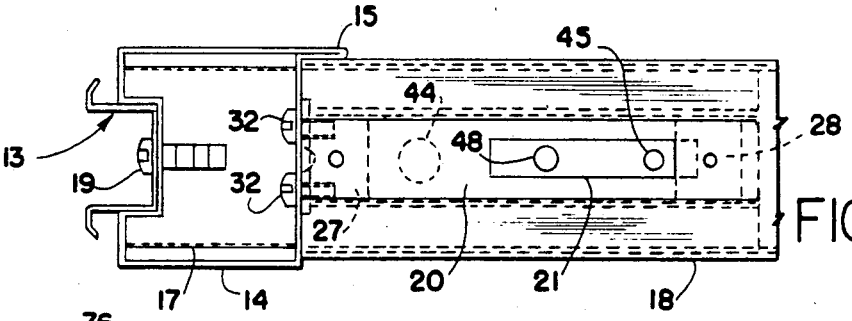
FIG. 2
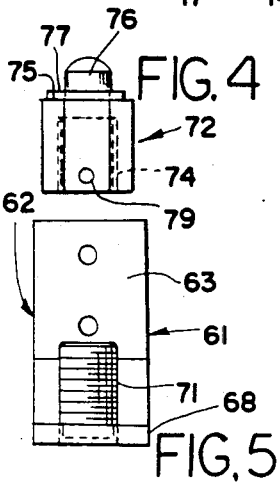
FIG. 4
FIG. 5
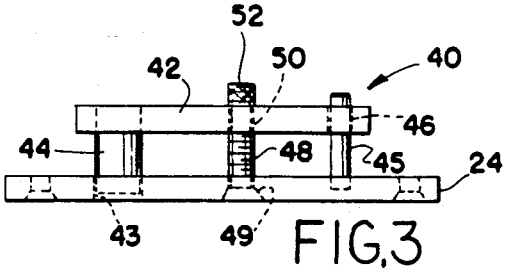
FIG. 3

INDEPENDENTLY ADJUSTABLE TOP AND BOTTOM HINGE PIN ASSEMBLIES

This invention relates generally as indicated to a door hinge assembly and more particularly to an adjustable door hinge assembly of simplified construction enabling the door readily to be height adjusted when in place and also easily to be mounted or hung and removed or unhung.

BACKGROUND OF THE INVENTION

Doors, particularly for demountable interior partitions, should be easily hung and unhung. Such doors, even full height doors, should also easily be height adjusted without requiring the door to be unhung, an adjustment made and then reinstalled.

Most doors using conventional leaf hinges cannot readily be hung or unhung and when hung cannot readily be height adjusted. Some door hinge assemblies use retractable top pintles but the mechanism for retracting and extending the pintles is usually quite complex and expensive. Levers requiring special connections which sometimes bind are often employed.

Also, most floors are not level in general construction. To operate properly the frame must be square and level for the door to swing true. This is a condition often not found in the mounting and demounting of interior partitions. Accordingly, a door hinge pivot which may allow for up to one-half inch or more out of level across the frame opening, while still being floor supported is desirable. The problem may of course be exacerbated by carpeting or under carpeting wiring.

Most door pivot hardware settles into carpeting under the weight of the door which may cause a binding condition, or require the door to be unhung, shims added and reinstalled. Also, most pivot designs are limited to a predetermined maximum door weight which is less than the weight of a full height door leaf for a 9 or 10 foot ceiling. Accordingly a simplified low cost, easily hung and unhung, door pivot assembly which can be adjusted with the door in place and accommodate sizable door weights is desirable.

SUMMARY OF THE INVENTION

A door hinge assembly includes a frame and a door with top and bottom hinge pivot assemblies. The top hinge pivot assembly includes a plate fixed to the frame and thereabove a parallel vertically movable plate. The upper plate includes a downwardly projecting hinge pin which projects through a clearance hole in the fixed plate. The fixed plate also includes an upwardly extending guide pin which extends through a clearance hole in the upper plate. A screw extends through the fixed plate and is threaded into the upper plate. When the screw is loosened the upper plate and thus the hinge pin may be pushed up, or permitted to drop into place. By tightening the screw the hinge pin is locked in its extended position and the screw head is flush with the bottom of the fixed plate. The bottom hinge pivot assembly includes an L-shape bracket with the vertical leg secured to the frame and the horizontal leg beneath the door. A threaded stud on the horizontal leg threadedly supports a nut-pin assembly with the upwardly projecting pin surrounded by a flat shoulder. A thrust washer on the shoulder supports the weight of the door and the door may be height adjusted by rotating the nut-pin assembly on the threaded stud and locking it in position.

To the accomplishment of the foregoing and related ends the invention, then, comprises the features hereinafter fully described and particularly pointed out in the claims, the following description and the annexed drawing setting forth in detail certain illustrative embodiments of the invention, these being indicative, however, of but a few of the various ways in which the principles of the invention may be employed.

BRIEF DESCRIPTION OF THE DRAWING

In the annexed drawing:

FIG. 1 is a fragmentary broken illustration partially in section of an interior partition door and frame illustrating the door and hinge assembly of the present invention;

FIG. 2 is a fragmentary top plan view of the top head;

FIG. 3 is a side elevation of the top pivot assembly illustrating the parallel plates separated and the hinge pin retracted;

FIG. 4 is an elevation of the bottom nut-pin assembly; and

FIG. 5 is an elevation of the bottom bracket as seen from the right hand side of such bracket in FIG. 1.

DETAILED DESCRIPTION OF THE PREFERRED EMBODIMENTS

Referring first to FIG. 1 there is illustrated a door 10 which is surrounded on the hinge side by a frame shown generally at 11. The frame includes a channel shape vertical shown generally at 13 to which is secured vertical box-like door frame 14. The vertical frame includes an inwardly directed folded flange 15. On the opposite vertical frame the folded flange may act as an abutment surface when the door is closed. On the hinge side the door may be provided with a clearance to permit the door to swing toward the viewer in FIG. 1.

In addition to the vertical frame 14 the frame may include a top rail 17 and a top strike 18. The rail is secured to the vertical and vertical frame by the fastener 19. The bottom 20 of the rail 17 is provided with a horizontal slot indicated at 21. The bottom wall 23 of the strike 18 has secured to the top thereof a fixed bottom plate 24. Plate 24 may be held in place by fasteners 25 and 26 extending through brackets 27 and 28, respectively. The former is in the form of an angle bracket and is secured to the interior wall 30 of vertical frame 14 by the fasteners seen at 32. The door opening is thus formed by the bottom wall 23 of the strike, the interior wall 30 of the vertical frames, and the floor 34.

The door 10 is provided with a top door plate 36 and a somewhat recessed bottom door plate 37. The door plates 36 and 37 are secured to the door each by a pair of fasteners seen at 38 and 39, respectively.

The top pivot assembly shown generally at 40 in addition to the fixed plate 24 includes a vertically movable parallel plate 42. The top pivot assembly is perhaps shown more clearly in FIG. 3. The bottom fixed plate 24 includes a clearance hole 43 for downwardly projecting hinge pin 44 which is secured to the parallel top plate 42. The fixed plate includes an upwardly extending guide pin 45 which extends through clearance hole 46 in the top plate. A flat head Philips machine screw indicated at 48 extends through a recessed clearance hole 49 in the fixed plate 24 and is threaded in tapped hole 50 in the top movable plate 42. The screw 48 is about midway between the hinge pin 44 and the guide pin 45. The threads at the tip of the screw may be deformed as indicated at 52 to prevent removal of the screw after loosening to provide an approximate half inch vertical travel of the plate 42 and thus the pin 44 as indicated more clearly in FIG. 3. Thus as the screw is loosened from below with continued pressure on the screw from the screwdriver, the plate 42 will move upwardly retracting the pin 44 from the receiving hole 53 in the top door plate 36. Conversely, as the screw is tightened, the top plate 42 will move downwardly extending the pin 44 through the clearance hole 43 and into the hole 53 in the top door plate. In this manner the top pin of the hinge assembly may conveniently be extended and retracted.

The bottom pivot assembly shown generally at 60 includes an L-shape bracket 61, the vertical leg 62 of which is reinforced by plate 63 and is secured by fasteners 64 and 65 to a lower extension 66 of the vertical 13.

The horizontal leg 68 of the bracket rests on tread plate 69 and projects beneath the hinge edge of the door. The horizontal leg includes an upwardly extending threaded stud 71 on which is threaded a nut-pin assembly 72.

The nut-pin assembly 72 includes a hexagonal exterior configuration and a blind tapped hole 74 in the bottom which is threaded on the stud 71. The top of the nut-pin assembly is provided with a flat shoulder 75 surrounding upwardly projecting pin 76. A plastic thrust washer 77 is positioned on the shoulder around the projecting pin 76. The pin 76 is provided with a rounded top and projects within hole 78 in the bottom door plate 37. The stud 71, the pin 76, and the pin 44 are vertically aligned as are the holes 78 and 53. The entire weight of the door is carried on the thrust washer 77 and the vertical height of the door may be adjusted by rotating the nut assembly 72 on the threaded stud 71. When the desired position of adjustment is obtained, the nut may be locked in position on the stud by the use of a socket head set screw 79. The set screw is provided with a plastic tip such as nylon to avoid damage to the threads of the stud.

It can now be seen that there is provided a low cost door hinge assembly which readily permits the door to be adjusted in place and readily to be hung or unhung when necessary.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A door hinge assembly for interior partitions including a frame and door, a top pivot assembly including a vertically downwardly extending top hinge pin projecting from the frame into said door, a bottom pivot assembly including a vertically upwardly extending bottom hinge pin projecting into said door, said top pivot assembly including a bottom plate secured to said frame, and a top parallel plate to which said top hinge pin is secured, said top hinge pin extending from said top plate downwardly through a clearance hole in said bottom plate, and adjusting means accessible from the bottom of said bottom plate to raise the lower said top plate to retract and extend said top hinge pin.

2. A door hinge assembly as set forth in claim 1 wherein said adjusting means comprises a vertically extending screw projecting through said bottom plate and threaded into said top plate.

3. A door hinge assembly as set forth in claim 2 including a guide pin projecting upwardly from said bottom plate and extending through a clearance hole in said top plate.

4. A door hinge assembly as set forth in claim 3 wherein said vertically extending screw is a flat head screw and projects through a hole in said bottom plate which includes a recess for the flat head of the screw whereby when said screw is fully tightened said top hinge pin extends fully downwardly and said screw head is flush with the bottom of said bottom plate.

5. A door hinge assembly as set forth in claim 4 wherein the top of said screw includes deformed threads to prevent removal of said screw from said top plate upon loosening of said screw.

6. A door hinge assembly as set forth in claim 5 wherein said screw is positioned between said top hinge pin and said guide pin.

7. A door hinge assembly as set forth in claim 1 wherein said bottom pivot assembly includes an L-shape bracket with the vertical leg of said bracket being secured to said frame and the horizontal leg extending beneath said door.

8. A door hinge assembly as set forth in claim 7 including a threaded stud projecting upwardly from said horizontal leg, and a nut assembly threadedly mounted on said stud, said nut assembly including an upwardly projecting bottom hinge pin.

9. A door hinge assembly as set forth in claim 8 including a shoulder on top of said nut assembly surrounding said bottom hinge pin, and a thrust washer on said shoulder supporting the weight of the door.

10. A door hinge assembly as set forth in claim 9 including means to lock said nut assembly in a selected position of rotation on said threaded stud to adjust and set the height of said door.

* * * * *